US005544592A

United States Patent [19]

Leezer

[11] Patent Number: 5,544,592

[45] Date of Patent: Aug. 13, 1996

[54] FOLDABLE AND EXTENDABLE TABLE FOR SPRAY BOOTHS

[76] Inventor: Matthew R. Leezer, 6648 67th Way North, Pinellas Park, Fla. 34665

[21] Appl. No.: 344,761

[22] Filed: Nov. 23, 1994

[51] Int. Cl.[6] ..... A47B 5/00

[52] U.S. Cl. ..... 108/48; 108/123

[58] Field of Search ..... 108/48, 42, 144, 108/132, 116, 123

[56] References Cited

U.S. PATENT DOCUMENTS

| | | | |
|---|---|---|---|
| 713,111 | 11/1902 | King | 108/123 |
| 3,257,933 | 6/1966 | Baylinson | 108/48 X |
| 3,271,069 | 9/1966 | Gondar | 297/423.27 X |
| 4,005,898 | 2/1977 | Way | 108/48 X |
| 4,047,488 | 9/1977 | Gutridge et al. | 108/48 X |
| 4,494,465 | 1/1985 | Fick, Jr. | 108/44 |
| 4,557,200 | 12/1985 | Geschwender | 108/132 |
| 4,838,180 | 6/1989 | Gutgsell | 108/132 |

*Primary Examiner*—Jose V. Chen
*Attorney, Agent, or Firm*—Joseph C. Mason, Jr.; Ronald E. Smith

[57] ABSTRACT

A table for use in a spray booth is foldable against a support wall when not in use. Telescoping arms engage opposite ends of the table and are pivotally mounted to the support wall so that the table is easily foldable against that wall when the telescoping arms are fully retracted. The table may be positioned in differing spatial relationships from the support wall when deployed into its operative configuration due to the telescoping arms. The table is supported by foldable legs that are foldable under the table, and the legs are interlocked to one another so that folding or unfolding one leg accomplishes folding or unfolding of the other legs as well. A pair of handles facilitates folding and unfolding of the table and a step facilitates climbing onto and descending from the table. A worker standing on the platform may walk along its length and reach any part of a vehicle parked in the spray booth due to the elevation provided by the table.

6 Claims, 4 Drawing Sheets

FOLDABLE AND EXTENDABLE TABLE FOR SPRAY BOOTHS

BACKGROUND OF THE INVENTION

1. Field of the Invention

This invention relates, generally, to a wall-mounted table that folds against the wall when not in use.

2. Description of the Prior Art

Spray booths are an important part of any automotive body shop because a good repair includes a paint job. While some vehicles have a profile low enough to enable a spray painter to reach all parts of the roof thereof, many vehicles, such as vans, are too high for a worker of average height to reach. Accordingly, a portable step ladder may be used when the roof of a high vehicle is to be painted. The painter must move the ladder whenever he or she needs to reach a part of the roof remote from the area in the vicinity of the ladder. Such ladder-moving is time-consuming and tires the painter. Moreover, step ladders are not particularly safe, especially when a worker is leaning toward a remote area in an attempt to avoid descending the ladder and moving it.

Portable tables or stands may also be used instead of ladders. The workers step up onto the table and are then free to walk along the length of the table as needed to reach remote spots. Tables are thus somewhat preferable to step ladders, but their large size creates storage problems. Moreover, storing and removing such tables from storage requires a large energy expenditure.

What is needed, then, is an improved table upon which a painter may stand when spray painting a vehicle. The improved table would occupy less storage space than the tables now in use, and its storage and retrieval from storage would require minimal exertion on the part of the painter.

However, in view of the art as a whole at the time the present invention was made, it was not obvious to those of ordinary skill in this art how such an improved structure could be provided.

SUMMARY OF THE INVENTION

The longstanding but heretofore unfulfilled need for an improved table is now met by the novel construction disclosed herein. The improved table of this invention includes a flat platform upon which a worker may stand or walk. The table has opposite ends longitudinally spaced apart from one another, a first telescoping arm having a distal end secured to a first end of said table, a second telescoping arm having a distal end secured to a second end of said table, a first bracket means secured to an upstanding support wall, said first telescoping arm having a proximal end pivotally secured to said first bracket means, a second bracket means secured to said upstanding support wall, said second telescoping arm having a proximal end pivotally secured to said second bracket means, a plurality of legs for supporting said table atop a support surface, said legs being foldably mounted to an underside of said platform, and said legs having a deployed configuration where they are disposed normal to a plane of said platform and a stored configuration where they are disposed substantially parallel to said plane of said platform, whereby said table is positionable atop said support surface by said telescoping means at a plurality of differing positions of functional adjustment relative to said support wall and whereby said table has a storage position where it lies generally parallel to said support wall.

The novel table further includes a leg interlocking means pivotally mounted to each leg of said plurality of legs so that folding one leg of said plurality of legs effects the folding of other legs in said plurality of legs.

In a preferred embodiment, the table has a rectangular configuration and includes a front edge and a back edge parallel to a plane of said support wall, and first and second ends that are disposed normal to said plane of said support wall.

A first telescopic guide is secured to said first end of the table and a second telescopic guide is secured to said second end of the table.

A first leg is pivotally mounted to the first end of the table, a second leg is pivotally mounted to a middle section of the table, and a third leg is pivotally mounted to the second end of the table.

The leg interlocking means includes an elongate rigid flat plate having a first end pivotally secured to the first leg, a middle part pivotally secured to the middle leg, and a second end pivotally secured to the third leg. Thus, pivotal displacement of any one of the three legs effects simultaneous and same direction pivotal displacement of the other two legs.

The primary object of this invention is to provide a spray booth table that is easily deployable from a stored configuration into a fully usable position, and vice versa, so that the table does not take up an appreciable amount of space when folded.

Another major object is to provide a table that may be positioned in a plurality of positions relative to a support wall so that said table may be adjusted relative to vehicles parked at differing distances from said wall.

Still another important object is to provide such a table having foldable legs so that said legs do not extend into the spray booth when the table is in its stored configuration.

Another object is to link the foldable legs together so that they need not be individually folded.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figures 1, 2:
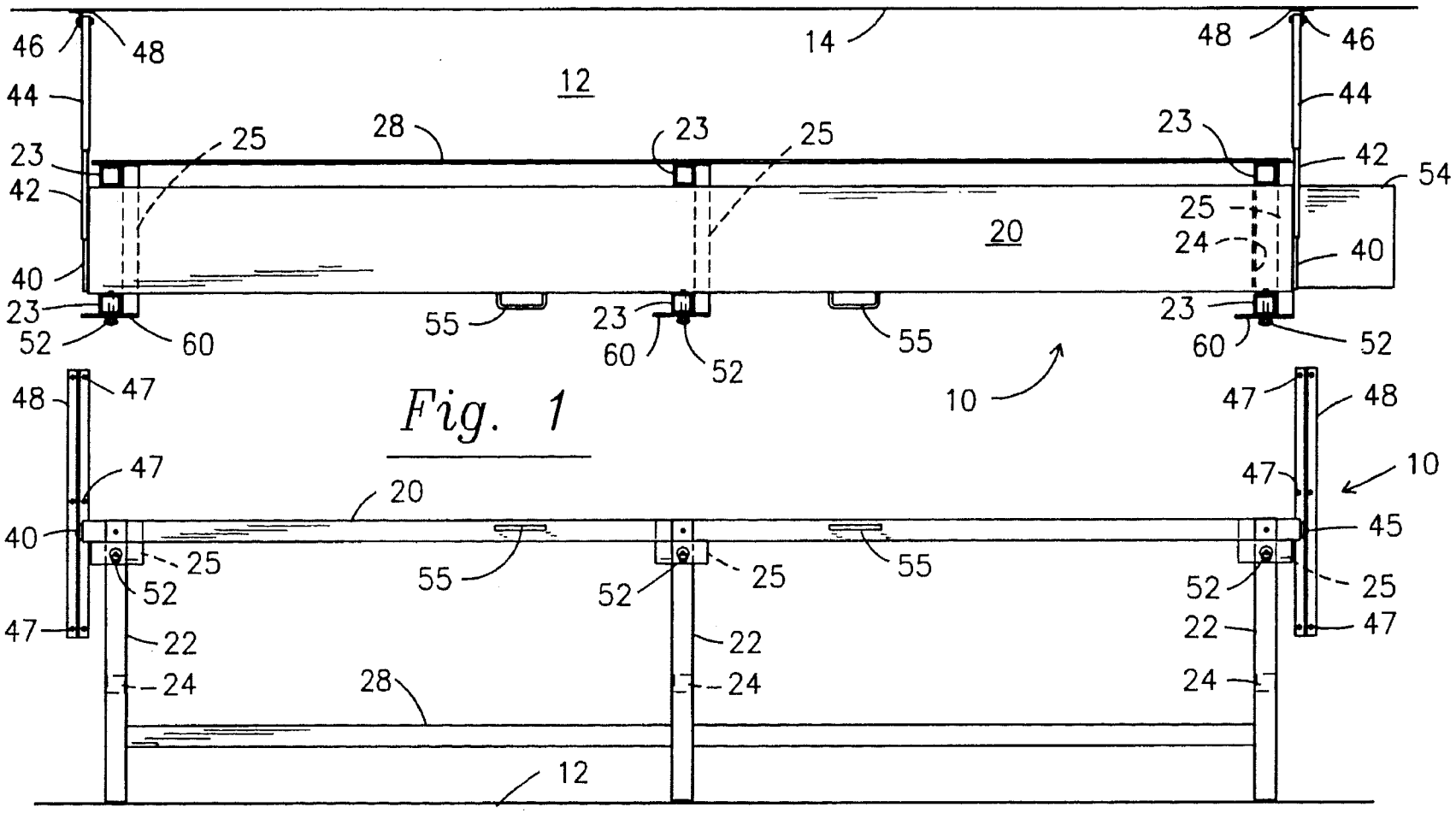
FIG. 1 is a top plan view of an illustrative embodiment of the invention when in its unfolded and extended configuration.
FIG. 2 is a front elevational view of the embodiment depicted in FIG. 1.

Referring now to FIGS. 1 and 2, it will there be seen that an illustrative embodiment of the invention is denoted as a whole by the reference numeral 10.

Although table 10 may be employed in a multitude of applications, it is depicted in use in a spray booth of the type found in auto body shops. Typically, spray booths are rectangular rooms within which is parked a vehicle to be painted. The booth includes a floor 12, a support wall 14, and other walls that are not depicted to simplify the illustration.

Table 10 includes an elongate, flat platform 20 that may be provided in any predetermined geometrical configuration but which is rectangular in this particular embodiment; it may have a monolithic structure or may include multiple sections. When operatively deployed, platform 20 is disposed in a horizontal plane, i.e., in parallelism to support surface 12; accordingly, workers may stand and walk thereatop when spray painting vehicles.

In this exemplary embodiment, platform 20 is supported by three sets of legs, collectively denoted 22. Each set of legs 22 includes a pair of upstanding leg members 23, 23 interconnected near their respective midpoints by a transversely disposed cross bar 24.

Figures 3, 4:
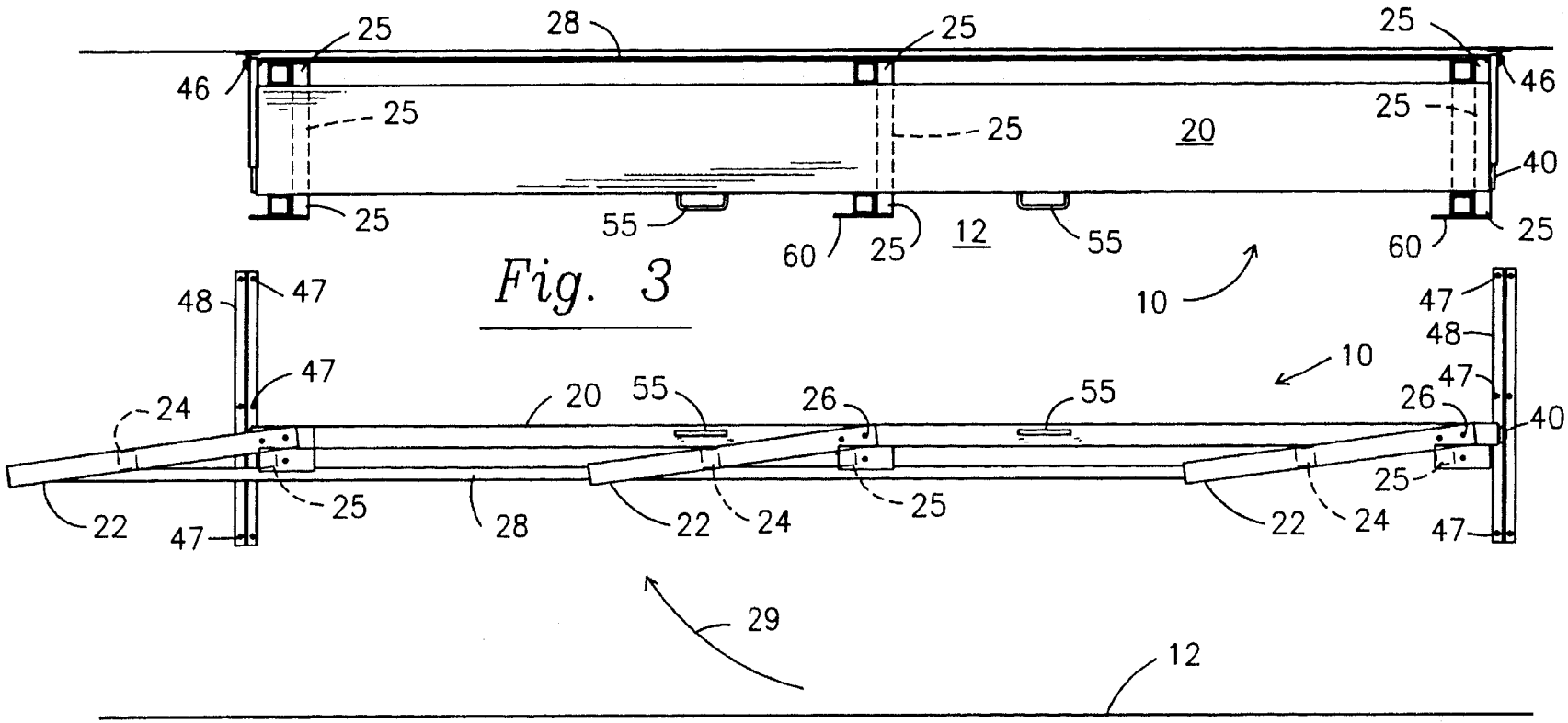
FIG. 3 is a top plan view of said illustrative embodiment when in its unfolded, retracted configuration.
FIG. 4 is a front elevational view similar to FIG. 2, but with the legs folded under the platform.

As perhaps best understood by comparing FIGS. 2 and 4, the uppermost end of each set of legs is pivotally mounted to the forward edge of platform 20 as at 26, and a longitudinally extending rigid flat plate 28 interconnects said legs at a suitable distance above their respective lowermost ends as depicted. Thus, pivotal movement of any one of said sets of legs in the direction indicated by directional arrow 29 in FIG. 4 effects simultaneous and corresponding pivotal rotation of the other sets of legs. When fully folded, each set of legs underlies platform 20 and is nearly parallel thereto as depicted in said FIG. 4.

As disclosed in FIG. 1, elongate flat plate 28 is positioned on the support wall 14 side of the novel table so that it does not present an obstacle when the table is deployed in its unfolded configuration.

Traversely disposed strengthening cross bars, collectively denoted 25, are secured to the underside of platform 20 adjacent each upstanding leg 23.

The means for extending and retracting the novel table with respect to support wall 14 includes a pair of telescopic guides, each member of said pair being denoted 40, secured in stand off relation to longitudinally spaced apart opposite ends of platform 20 as best depicted in FIG. 2. A slightly enlarged view of one of the telescopic guides is provided in FIG. 6. Each telescopic guide 40 is telescopically engaged by an associated telescoping arm 42 (FIG. 1). Each arm 42 is telescopically engaged by a telescoping arm 44, and each arm 44 is pivotally engaged at pivot point 46 to a vertically extending bracket 48 mounted to support wall 14. This construction enables platform 20 to be fully extended from support wall 14 as depicted in FIG. 1, or fully retracted with respect to said support wall as depicted in FIG. 3, or to be configured in any position between said fully extended and retracted configurations to accommodate vehicles of varying widths.

Many spray booths have light fixtures and associated wiring along support wall 14 and it may not be possible to attach vertically extending bracket 48 to support wall 14 at any particular location. Accordingly, the vertically elongated aspect of bracket 48 enables attachment of said bracket 48 to support wall 14 at any number of vertically spaced apart points of attachment. This enables attachment of the bracket to the wall to take place at locations that are unaffected by the lighting fixtures and associated wires. For example, note in FIG. 2 that screws or other suitable fastening means, collectively denoted 47, are positioned at the top, middle, and bottom of each bracket 48; if wires associated with a lighting fixture were present at said locations, the elongated aspect of the bracket would provide numerous other attachment points along the length thereof that could be utilized to secure the bracket to the wall.

Figure 6:
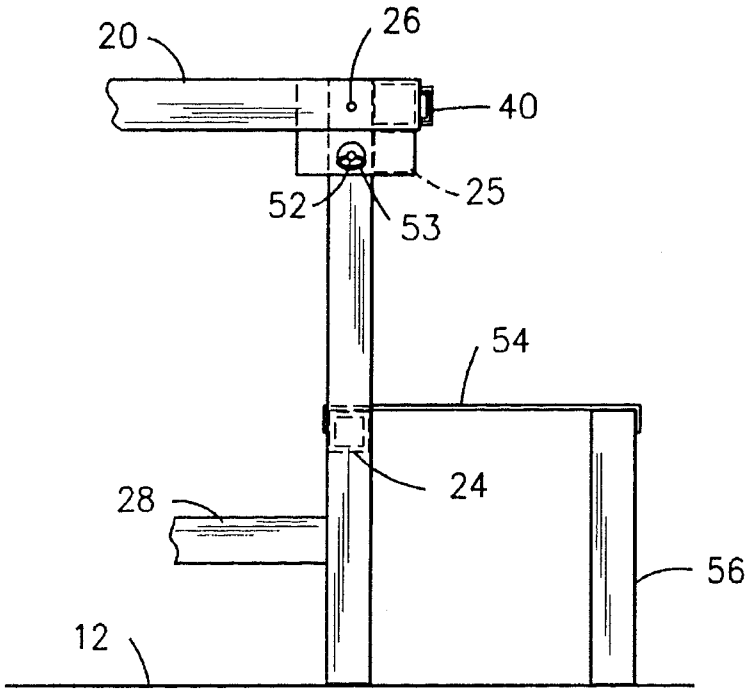
FIG. 6 is a partial, broken away front elevational view of the table when an auxiliary step means is attached thereto.
Figure 5:
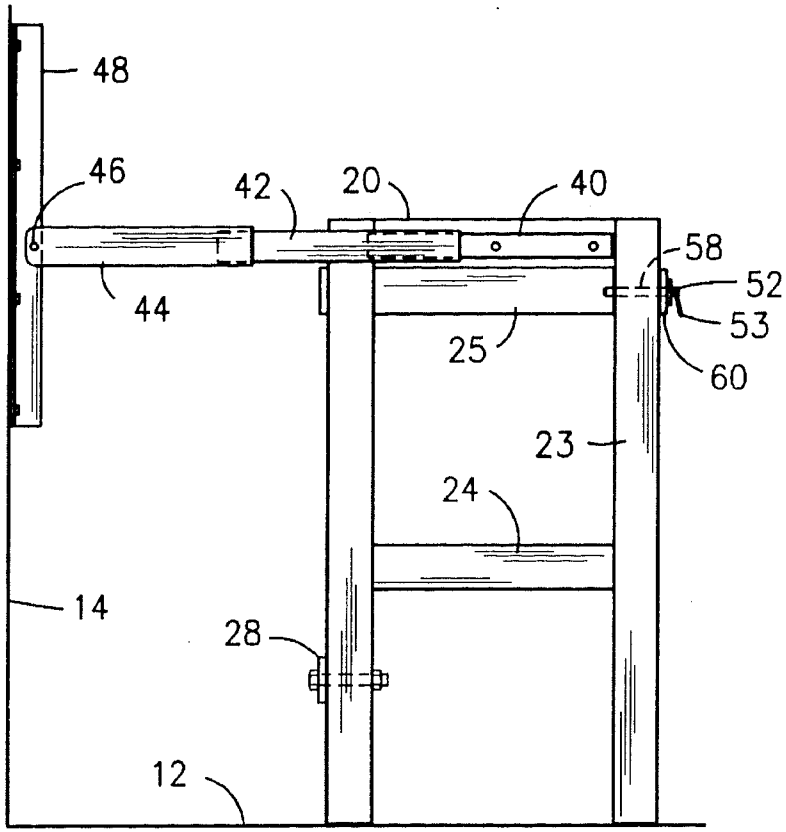
FIG. 5 is a side elevational view of the table when in its unfolded and extended configuration.

FIG. 6 depicts a step means 54 that may be detachably mounted at one end or both ends of the table to facilitate stepping onto platform 20. Note that the step is supported by cross bar 24 and by auxiliary legs 56; the step need not be fastened to cross bar 24 because gravity holds it in place. Such nonfastening facilitates both attachment and detachment of the step to and from the table. Auxiliary legs 56 and step 54 are preferably fixedly secured to one another.

Figure 8:
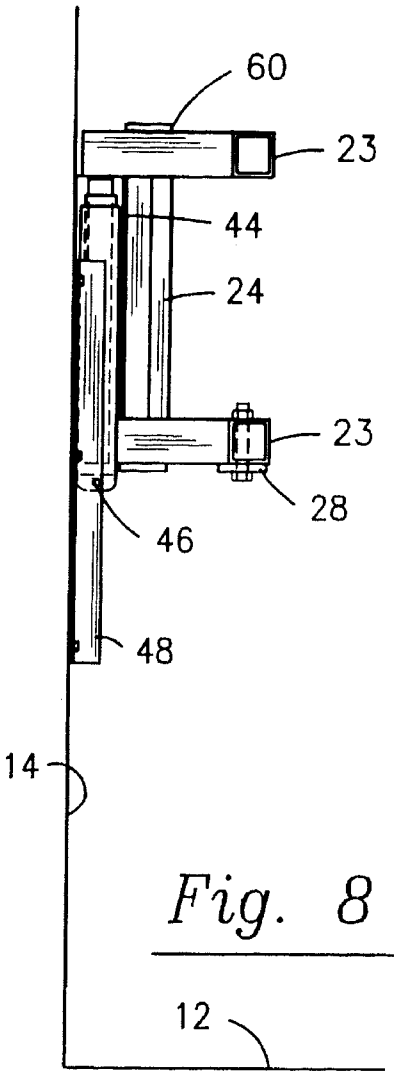
FIG. 8 is a side elevational view of the table when in its fully retracted and folded configuration.
Figure 7:
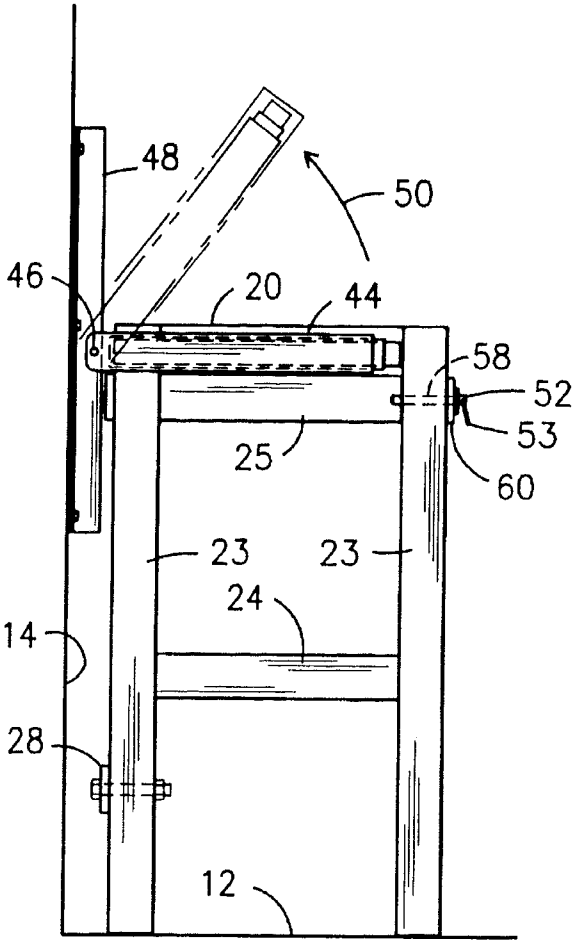
FIG. 7 is a side elevational view similar to FIG. 5, depicting the table in its unfolded, retracted configuration.

Directional arrow 50 in FIG. 7 indicates the direction of displacement of table 10 when it is to be stored in its folded configuration as depicted in FIG. 8. It should be understood that after use, table 10 is placed into its fully retracted (FIG. 3) position before it is folded about pivot points 46 into its FIG. 8 position. Legs 22 are folded under platform 20 either before or after the retracted table has been folded in the direction of said arrow 50.

Detent members 52 having swivally mounted handles 53 prevent unwanted pivoting of legs 23 about their respective pivot points 46. Each detent 52 includes a pin 58 (see FIG. 6) that extends through an aperture formed in a thin flat plate 60 that is secured to each leg 23 and through a bore formed in its associated leg 23. Thus, when the detent is fully inserted into the bore formed in a leg 23, said pin prevents relative rotation between each plate 60 and its associated leg. Removal of each detent enables relative rotation between each leg 23 and its associated pivot point 46.

Laterally spaced apart handles 62, 62 facilitate manipulation of table 10 during the folding and unfolding process.

Figure 9:
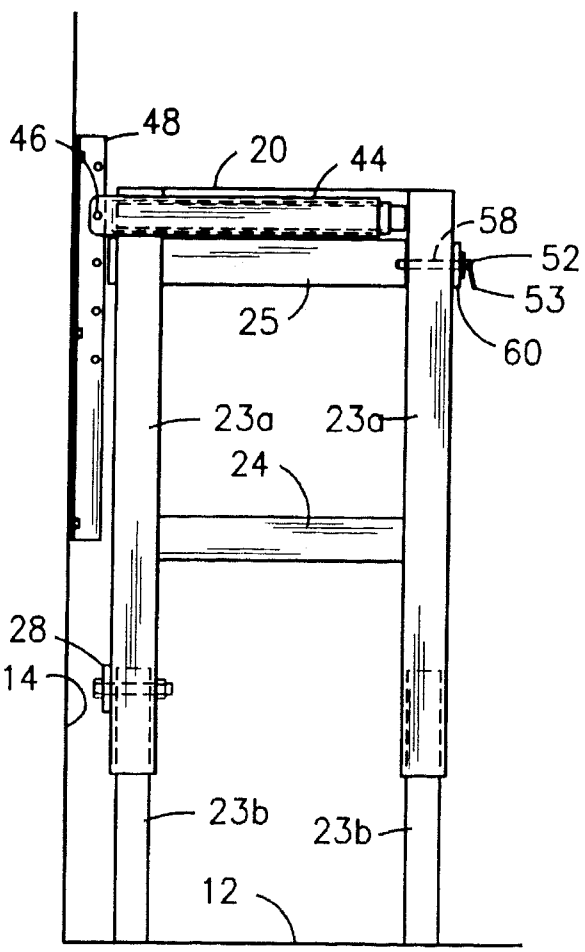
FIG. 9 is a side elevational view of a second embodiment having legs of adjustable length.

FIG. 9 discloses an embodiment where legs 23, 23 are adjustable in length so that platform 20 may be positioned at differing heights. Specifically, legs 23, 23 include telescoping parts 23*a*, 23*b* that enable such height adjustment. A suitable detent means, not shown, is employed to lock the leg parts into a preselected position of adjustment. The configuration of FIG. 9 enables workers to reach the top of very high vehicles.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A table, comprising:

a flat platform;

said platform having opposite ends longitudinally spaced apart from one another;

a first telescoping arm having a distal end secured to a first end of said platform;

a second telescoping arm having a distal end secured to a second end of said platform;

a first bracket means secured to an upstanding support wall;

said platform having a rectangular configuration including a front edge and a back edge parallel to a plane of said support wall;

said first and second ends of said platform being disposed normal to said plane of said support wall;

a first telescoping guide secured to said first end of said platform for slideably receiving said first telescoping arm;

a second telescoping guide secured to said second end of said platform for slideably receiving said second telescoping arm;

said first bracket means being an elongate bracket member that is vertically disposed to facilitate its mounting to said upstanding support wall;

said first telescoping arm having a proximal end pivotally secured to said first bracket means;

a second bracket means secured to said upstanding support wall;

said second bracket means being an elongate bracket member that is vertically disposed in parallel relation to said first bracket means to facilitate its mounting to said upstanding support wall;

said second telescoping arm having a proximal end pivotally secured to said second bracket means;

leg means for supporting said table atop a support surface;

said leg means being foldably mounted to an underside of said platform, said leg means having a deployed configuration where they are disposed normal to a plane of said platform and having a stored configuration where they are disposed substantially parallel to said plane of said platform;

said leg means including a plurality of legs, said plurality of legs including a first leg pivotally mounted to said first end of said platform, a second leg pivotally mounted to a middle section of said platform, and a third leg pivotally mounted to said second end of said platform;

leg interlocking means pivotally connected to each leg of said plurality of legs so that folding a preselected leg of said plurality of legs in a first direction simultaneously effects folding of other legs in said first direction;

whereby said table is positionable atop said support surface by said telescoping means at a plurality of differing positions of functional adjustment; and whereby said table has a storage position where it lies generally parallel to said upstanding support wall.

2. The table of claim 1 wherein said leg interlocking means includes an elongate rigid flat plate having a first end pivotally secured to said first leg, a middle part pivotally secured to said second leg, and a second end pivotally secured to said third leg.

3. The table of claim 1, further comprising a step means detachable from said table, said step means facilitating entry onto and departure from said platform.

4. The table of claim 1, wherein said legs have a telescopic construction and further including detent means for locking said legs in a plurality of positions of telescoping adjustment so that said platform may be positioned at differing vertical elevations.

5. The table of claim 1, further comprising detent means for preventing pivoting of said legs when said legs are in a deployed configuration.

6. The table of claim 5, further comprising a plate secured to each leg, said plate being apertured, and further comprising a bore formed in each leg in alignment with said aperture, said detent means including a pin that is selectively removably selectively inserted through said aperture and into said bore so that said pin prevents pivotal rotation of its associated leg when inserted into said bore and which allows pivotal rotation of its associated leg when withdrawn from said bore.

* * * * *